US010328731B2

(12) United States Patent
Klocke et al.

(10) Patent No.: US 10,328,731 B2
(45) Date of Patent: Jun. 25, 2019

(54) PRINTER FOR PRINTING OBJECTS

(71) Applicant: Phoenix Contact GmbH & Co. KG, Blomberg (DE)

(72) Inventors: Sandra Klocke, Vlotho (DE); Peter Isaak, Detmold (DE); Albrecht Schierholz, Schieder-Schwalenberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 204 days.

(21) Appl. No.: 15/410,216

(22) Filed: Jan. 19, 2017

(65) Prior Publication Data

US 2017/0210156 A1 Jul. 27, 2017

(30) Foreign Application Priority Data

Jan. 22, 2016 (DE) ..... 10 2016 101 111

(51) Int. Cl.
*B41J 29/02* (2006.01)
*B41J 29/38* (2006.01)
(Continued)

(52) U.S. Cl.
CPC ..... *B41J 29/38* (2013.01); *B41J 2/32* (2013.01); *B41J 3/36* (2013.01); *B41J 3/407* (2013.01);
(Continued)

(58) Field of Classification Search
CPC ..... B41J 29/38; B41J 3/36; B41J 2/32; B41J 3/407; B41J 3/46; B41J 29/13
See application file for complete search history.

(56) References Cited

U.S. PATENT DOCUMENTS 4,851,412 A * 7/1989 Cooper ..... C07D 471/04 514/263.22
4,859,092 A * 8/1989 Makita ..... B41J 3/36 400/83
(Continued)

FOREIGN PATENT DOCUMENTS

EP 2 536 194 A1 12/2012
JP 2003-143339 A 5/2003
JP 2009-088759 A 4/2009

OTHER PUBLICATIONS

Computer-generated translation of JP 2009-88759, published on Apr. 2009.*

*Primary Examiner* — Huan H Tran
(74) *Attorney, Agent, or Firm* — David S. Safran; Roberts Mlotkowski Safran Cole & Calderon, P.C.

(57) ABSTRACT

A printer for printing objects for marking electrical components, having a housing, a printing space formed inside of the housing, a printing device, a receiving device for a replaceable magazine for receiving the object to be printed, a control and evaluation unit, and an input and display device, wherein the receiving device can move between a loading and unloading position outside of the printing space and a printing position inside of the printing space. The printer has lower and upper housing parts, wherein the printing space, the printing device, the receiving device, and the control and evaluation unit are arranged in the lower housing part. A tablet computer is pivotably attached on the top side of the upper housing part, whereby the tablet computer can be locked in an upwardly pivoted position, and the upper housing part is mounted to pivot about a rotational axis on the lower housing part.

9 Claims, 6 Drawing Sheets

(51) Int. Cl.

| | |
|---|---|
| ***B41J 2/32*** | (2006.01) |
| ***B41J 3/407*** | (2006.01) |
| ***B41J 3/46*** | (2006.01) |
| ***B41J 29/13*** | (2006.01) |
| ***B41J 3/36*** | (2006.01) |

(52) U.S. Cl.
CPC ..... *B41J 3/46* (2013.01); *B41J 29/02* (2013.01); *B41J 29/13* (2013.01)

(56) References Cited

U.S. PATENT DOCUMENTS

| | | | | |
|---|---|---|---|---|
| 4,946,300 | A * | 8/1990 | Makita | B41J 3/36 361/679.06 |
| 5,248,207 | A * | 9/1993 | Yamamoto | B41J 17/32 400/120.16 |
| 5,546,270 | A * | 8/1996 | Konno | B41J 3/46 248/288.31 |
| 6,856,506 | B2 * | 2/2005 | Doherty | G06F 1/1632 16/329 |
| 7,580,249 | B2 | 8/2009 | Tsuji | |
| 8,303,100 | B2 | 11/2012 | Schierholz et al. | |
| 8,550,923 | B2 * | 10/2013 | Piazzai | B41J 3/46 463/46 |
| 8,763,976 | B1 * | 7/2014 | Jachim | B41J 29/04 108/43 |
| 9,802,422 | B2 * | 10/2017 | Klocke | B41J 2/325 |

* cited by examiner

PRINTER FOR PRINTING OBJECTS

BACKGROUND OF THE INVENTION

Field of the Invention

The invention relates to a printer for printing objects for marking electrical components, comprising a housing, a printing space formed inside of the housing, a printing device, a receiving device for a replaceable magazine for receiving the object to be printed, a control and evaluation unit, and an input and display device, wherein the receiving device can switch between a loading and unloading position outside of the printing space and a printing position inside of the printing space.

Description of Related Art

In industrial and commercial practice, different types of labeling and marking signs are used to label and mark machines, devices, terminals, cables, or conductors. Information regarding the components to which the signs correspond is placed on these same labeling and marking signs. To this end, the labeling or marking signs are placed in a printer with a corresponding printing pattern—usually alphanumeric characters. Different printers with different printing methods are used for marking—for example, inkjet printers, thermal transfer printers, or UV printers. These types of marking printers are, for example, known from the catalogue "Markierungssysteme Werkzeuge Montagematerial, 2013/2014," pages 28 to 37, from Phoenix Contact GmbH & Co. KG.

In practice, printing objects in card format that have a number of individual marking signs are often used. The printing objects are thereby especially designed as plastic injection parts or as punched plastic parts. In the case of plastic injection parts, which are also called Universal Card Material (UniCard or UC-Material), the marking signs are secured in an external frame via holding strips. After printing, the individual marking signs, which are often used for conductor and cable marking or for terminal marking, can be detached from the frame. In the case of punched plastic parts, which are also called Universal Sheet Material (UniSheet or US-Material), multiple rows of marking signs together form a printing object, whereby the individual marking signs can be separated from one another after the US-Material is printed on.

Additionally, multiple labeling or marking signs can be placed, especially affixed, on a common carrier sheet from which the individual labeling or marking signs can, after marking, be simply removed. Carrier sheets of this type are, in practice, also called label sheets or sticker sheets.

The different types of labeling materials will hereinafter be generally referred to as printing objects or objects to be printed, whereby the printing objects may be composed of different materials, especially different plastics, and have different dimensions, especially different material thicknesses. In order to be able to print different printing objects with different dimensions using a printer, the individual printing objects are deposited or inserted into a magazine appropriate for the printing object in the printer in question. Typically, multiple printing objects can be individually deposited into one magazine, so that the number of printing objects is greater than the number of magazines. If all magazines have the same external dimensions, the magazines can each be inserted into the receiving device of the printer, which can be moved between a loading and unloading position outside of the printing space and a printing position inside of the printing space like a drawer.

Thermal transfer printers have proven to be especially suited for printing of objects of this type. In thermal transfer printing, a special foil coated with a temperature-sensitive ink is passed between the printing object and a thermal printing head as a printing device, wherein the foil can be arranged as an ink ribbon in a corresponding printer cartridge. Thermal transfer printing produces an exact color print and a high printing quality with a high surface gloss level.

The printer in question (which should preferably be a thermal transfer printer) should be able to print a variety of different printing objects. There is thus a variety of different magazines for the printer which can be individually inserted into the receiving device. Furthermore, several different printer cartridges with different ink ribbons can be used.

In the case of a portable thermal transfer printer, known from practice, the housing has an essentially L-shaped housing part and a housing hood that can pivot laterally, attached on the upper side of the fixed housing part. The ink ribbon is arranged underneath the pivoting housing hood, so that an ink ribbon can be inserted or replaced by raising the housing hood laterally. Input of printing parameters and printing data can take place via the input and display device arranged in the fixed housing part. As the input and display device has relatively small dimensions and also few function keys, input of printing parameters and printing data preferably takes place via corresponding software, wherein the input then takes place on an external computer with the help of graphical user interfaces. This type of inputting printing data is very comfortable for the user, particularly since the printing parameters and printing data are often already provided by corresponding printing software packages. In this case, however, an external computer has to be connected to the printer.

SUMMARY OF THE INVENTION

The primary object of the present invention is to provide a printer of the type described at the outset for printing of objects for marking electrical components that has a compact design, and enables simple and user-friendly operation even when the printer is not connected to an external computer.

This object is accomplished by the printer according to the invention in that the housing has a lower housing part and an upper housing part, wherein the printing space, the printing device, the receiving device, and the control and evaluation unit are arranged in the lower housing part and that a tablet computer is provided as an input and display device. The tablet computer is thereby attached on the top side of the upper housing part, which can pivot about a rotational axis and can be locked in an upwardly pivoted position. Additionally, the upper housing part is mounted pivotable about a rotational axis on the lower housing part.

Because a tablet computer is provided as an input and display device for the printer according to the invention, the input of printing parameters and printing data is possible for the user in a very simple and easy manner "Tablet computer" is currently understood to mean a flat data processing unit that has a touch-sensitive screen (touchscreen) and can be operated with a finger and/or stylus. Such tablet computers are generally referred to as tablet-PCs or simply as tablets. As the size (screen diagonal) of conventional tablet computers amounts to at least 7 inches, commonly even 10 inches or more, it is possible to depict the input mask of a printing object to be printed on the touchscreen in such a manner that the input mask optically essentially corresponds to the printing object. Upon input of the printing data, the user directly sees how the corresponding printed printing object will look. For the input of printing data and printing parameters, a full keyboard—rather than just a few function keys—can be made available as needed via the touchscreen.

Operation of the printer according to the invention is made even easier for the user due to the fact that the tablet computer is mounted to be able to pivot on the top side of the upper housing part and can be locked in an upwardly pivoted position. By this means, the user can bring the tablet computer into a position in which inputting of the printing data as well as reading of data and values shown on the touchscreen are especially easy and comfortable for the user. On the other hand, the tablet computer can, especially during transport, be pivoted back into the base position and preferably also latched there in that it locks as flush as possible with the top side of the upper housing part so that the tablet computer is optimally protected against damage.

In order to ensure that loading and or replacing an ink ribbon or ink ribbon cartridge is easy and comfortable—even when the tablet computer is arranged on the top side of the upper housing part—the housing is designed as two parts, wherein especially the printing device with the print head and the ink ribbon or an ink ribbon cartridge are arranged in the lower housing part. Because the upper housing part is positioned so as to be able to pivot on the lower housing part, the upper housing part can be simply rotated upwards so that especially the printing device with the ink ribbon or the ink ribbon cartridge arranged in the lower housing part is then comfortably accessible for the user, so that an ink ribbon or an ink ribbon cartridge can be removed from the lower housing part or simply inserted into the lower housing part. Furthermore, when the upper housing part is pivoted upward, other components of the printer arranged in the lower housing part can also be removed for repair (where applicable).

According to one preferred configuration of the printer according to the invention, the rotational axis of the tablet computer is arranged in the vicinity of the front side of the printer, where the receiving device is also arranged. The tablet computer can thus be pivoted upward such that its user interface—i.e., the touchscreen—faces a user who is in front of the front side of the printer. As the receiving device for loading or removing a magazine slides out of the front side of the printer like a drawer, a user, as a general rule, is situated in front of the front side of the printer during operation of the printer.

Furthermore, according to another, especially preferred configuration of the printer according to the invention, the rotational axis of the upper housing part is arranged near the rear of the printer, so that a user, who, on the other hand, is standing in front of the front side of the printer, looks directly at the top of the lower housing part when the upper housing part is pivoted upward. As a result, the user—when the upper housing part is pivoted upward—has easy access to the printing device arranged in the lower housing part, so that he/she can (after disengaging a corresponding latch and/or opening a cover, where applicable) insert or replace an ink ribbon or ink ribbon cartridge.

More advantageously, the upper housing part can be locked in its upwardly pivoted position, so that an undesired closing of the upper housing part is prevented. The pivoting arrangement of the tablet computer on the upper housing part as well as of the upper housing part on the lower housing part can be implemented in various ways. The locking of the tablet computer or the upper housing part in their respective upwardly pivoted positions can likewise be achieved by means of various design measures.

According to one advantageous configuration, a U-shaped bracket with a Crosspiece and two Arms is provided mounted to pivot on the tablet computer. For this purpose, the ends of the Arms leading away from the Crosspiece are mounted to pivot on two opposite sides of the tablet computer. To this end, for example, a hole can be formed in each side of the tablet computer, into which hole a stud arranged on the end of the Arm protrudes. Studs can, however, just as well be formed on the sides of the tablet computer; in this case, corresponding holes are formed in the ends of the Arms. To achieve the locking of the tablet computer in its upwardly pivoted position, outwardly protruding studs are preferably designed on the ends of the Arms facing the U-back. These studs protrude into lateral guiding and locking grooves that are formed on either side of the upper side of the upper housing part. An indentation can thereby be formed on one end of each of the guiding and locking grooves, into which the lateral studs of the Arms of the bracket extend in the upwardly pivoted position of the tablet computer, so that the tablet computer is locked in this position.

In place of a U-shaped bracket, a rectangular frame can be pivotably mounted on the tablet computer, wherein especially one arm of the frame can serve as a pivot axis which, for example, can be locked in a corresponding groove on the bottom of the tablet computer.

As stated at the outset, the tablet computer, as an input and display device, is mounted to pivot on the top side of the upper housing part of the printer; that is, the tablet computer can pivot but is fixedly and permanently connected to the printer. Consequently, there is no provision for the tablet computer to be removed from the printer by a user or for another tablet computer to be attached to the printer. Because the tablet computer is thus mechanically permanently connected—albeit pivotably—to the upper housing part of the printer, the electrical connection of the tablet computer to the printer preferably also occurs via a fixed connection, namely via a cable, especially a flat ribbon cable. Especially the data exchange between the tablet computer and the control and evaluation unit in the lower housing part of the printer takes place via the cable.

Preferably, a first opening for the cable is formed in the upper housing part in the region of the rotational axis of the tablet computer and a second opening for the cable is formed in the lower housing part in the region of the rotational axis of the upper housing part. These openings serve to guide the cable simply and securely. By forming the openings in each of the regions of the rotational axes, there is no interference by the cable when the tablet computer or the upper housing part is pivoted upward and vice-versa: the cable is not damaged by pivoting the tablet computer or the upper housing part. The cable then runs essentially in an S-shape from the tablet computer arranged on the top side of the upper housing part through the first opening in the upper housing part, along the bottom of the upper housing part, to the opening in the lower housing part, through the second opening in the lower housing part, and then inside of the lower housing part to the control and evaluation unit.

Because the cable runs along the bottom of the upper housing part, the cable is also protected against damage when the upper housing part is open—for example, when a user replaces an ink ribbon cartridge while the upper housing part is open. As additional protection for the cable, a cover arranged on the bottom side of the upper housing part can be provided.

If the tablet computer is—as described above—connected to the printer, especially to the control and evaluation unit arranged in the lower housing part, via a cable, then it is preferably not only the data exchange between the tablet computer and the control and evaluation unit that takes place via the cable but also the power supply of the tablet computer as well. Alternatively, the power supply of the tablet computer can take place wirelessly, namely in that a charger interface for charging a rechargeable battery in the tablet computer is arranged on the top side of the upper housing part. The charging process thereby preferably takes place with the tablet computer pivoted downward, so that the charger interface is arranged to be away from the rotational axis of the tablet computer. The charger interface can thereby be configured as a contact charger interface or an inductive charger interface. Especially when the upper housing part has a charger interface for the power supply of the tablet computer, the printer is preferably configured such that the data exchange between the tablet computer and the control and evaluation unit also takes place wirelessly, especially by means of radio via WLAN or Bluetooth.

Specifically, there are a number of possible ways to configure and further develop the printer according to the invention as will be apparent from the following description of preferred embodiment examples in connection with the accompany drawings.

DETAILED DESCRIPTION OF THE INVENTION

Figure 1:
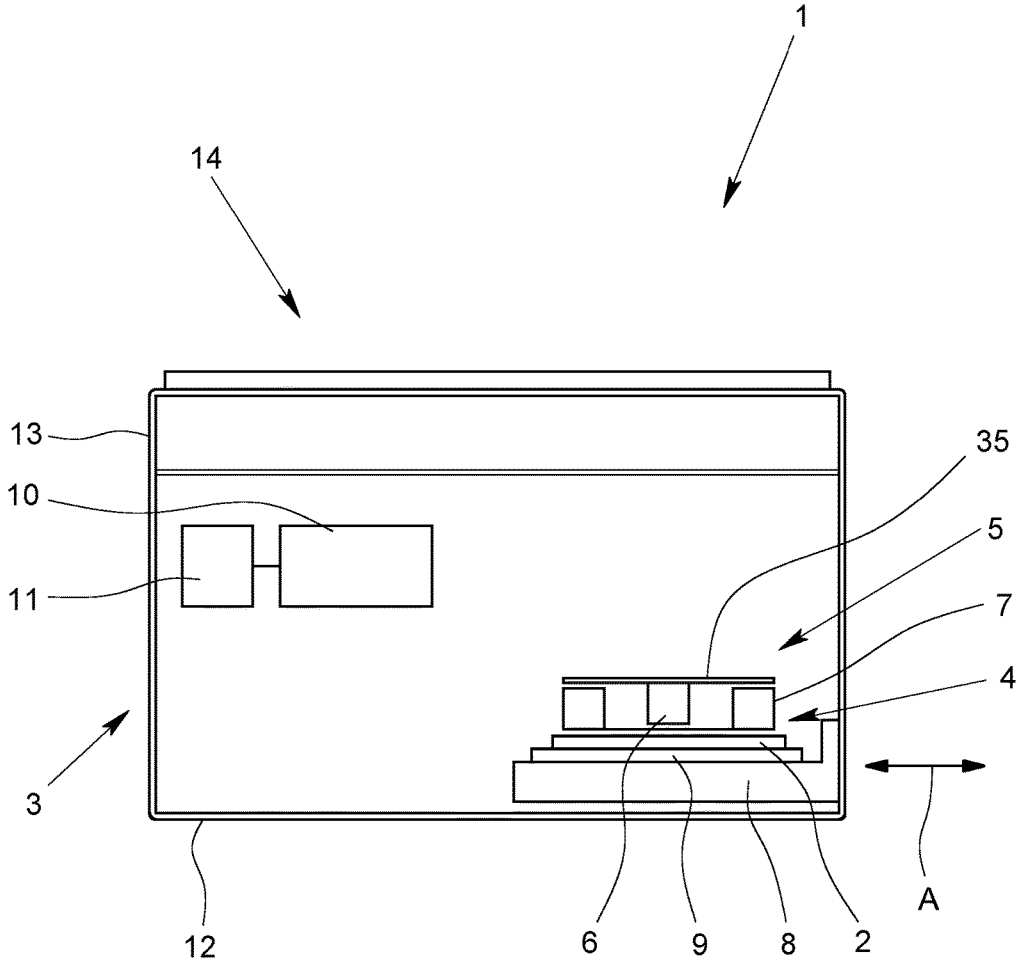
FIG. 1 is a schematic depiction of a printer in a longitudinal cross-sectional view.

FIG. 1 shows a printer 1 according to the present invention in a greatly simplified schematic depiction in a longitudinal cross-sectional view. The printer 1, preferably a thermal transfer printer, serves for printing of printing objects 2, especially in card form or in the form of carrier sheets. The printer 1 has a housing 3 in which a printing space 4 is formed. Additionally, a printing device 5 is arranged in the housing 3 and has a print head 6 and an ink ribbon cartridge 7 whose ink ribbon is, during the printing process, arranged above the object to be printed 2 with very little distance in between. A receiving device 8, designed like a drawer or a transport carriage, can be switched between a loading and unloading position outside of the printing space 4 and a printing position inside of the printing space 4. The movement direction of the receiving device 8 in FIG. 1 runs in the direction of the arrow A, whereby the receiving device 8, in the depiction according to FIG. 1, is arranged inside of the printing space 4—that is, in the printing position. The receiving device 8 serves to receive a magazine 9, into which the printing object(s) 2 to be printed can be loaded. In this way, it is ensured that the object to be printed 2 can be brought into the printing space 4 in a simple and comfortable manner and also that the printing object 2 is always in a prescribed position inside of the printing space 4.

Figure 4:
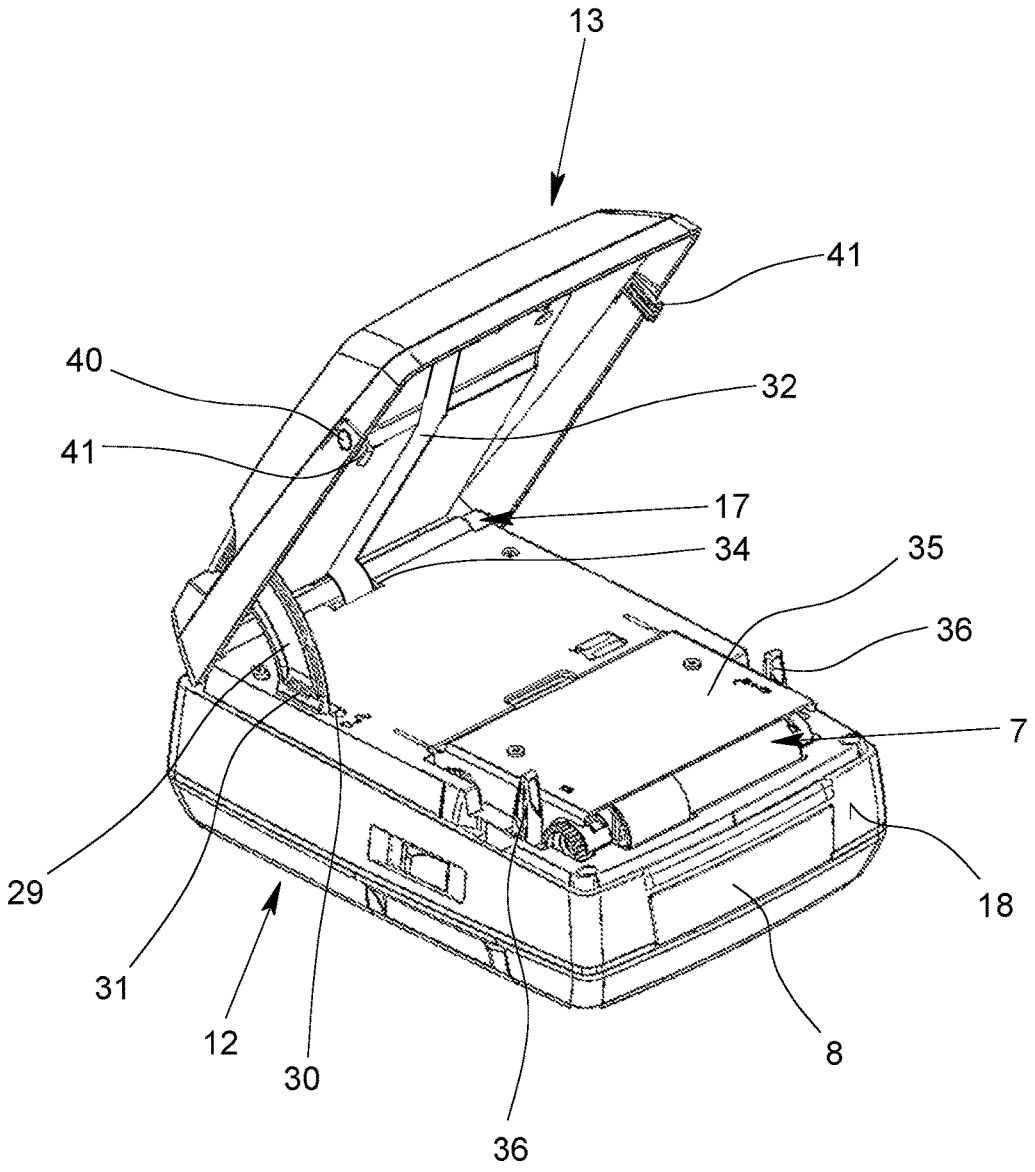
FIG. 4 is a perspective view of the printer seen at an angle from the front with an upwardly pivoted upper housing part.
Figure 5:
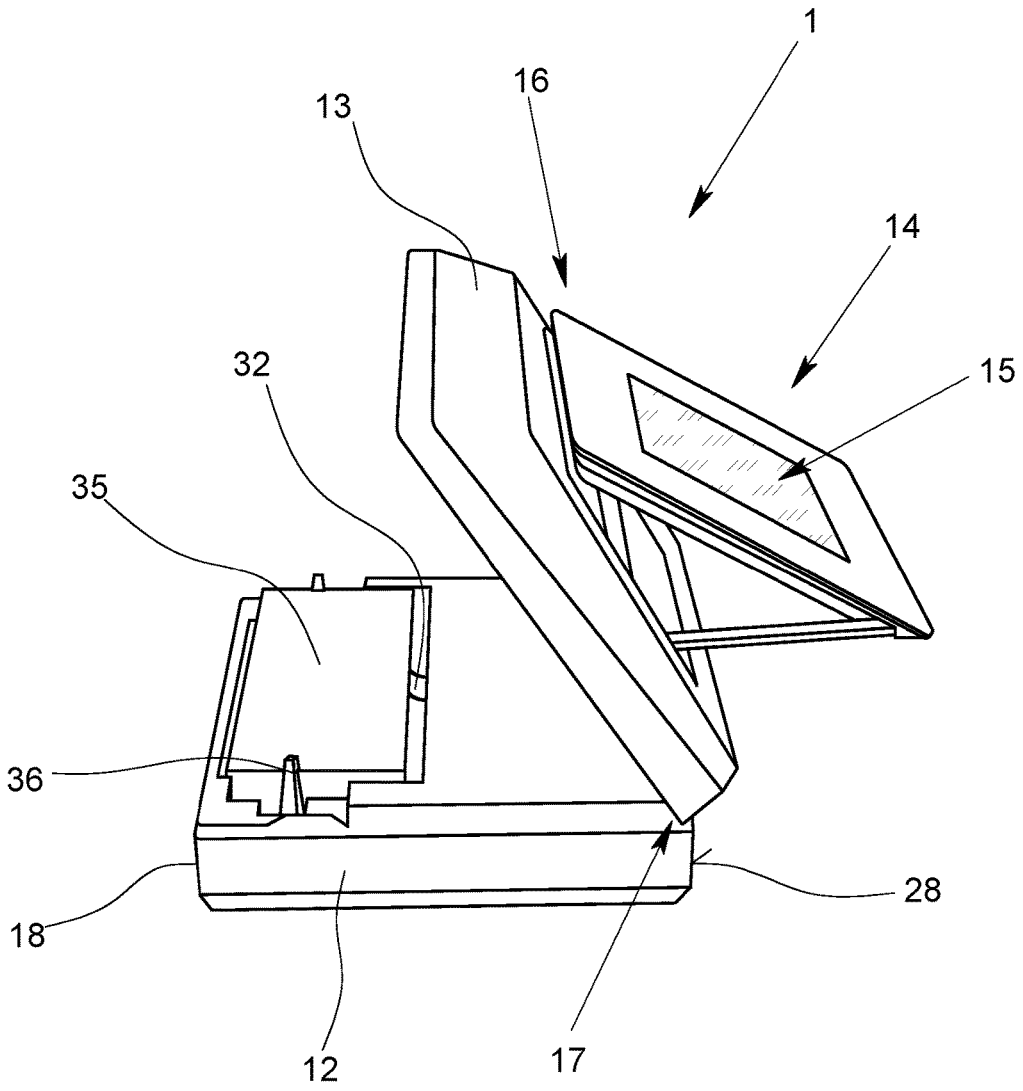
FIG. 5 is a perspective view of the printer seen at an angle from the side with an upwardly pivoted tablet computer and an upwardly pivoted upper housing part.

In order to control the printing process, especially a control and evaluation unit 10 as well as a storage device 11 that is connected to the control and evaluation unit 10 are additionally arranged in the printer 1. These are only very schematically depicted in FIG. 1. The control and evaluation unit 10 is additionally connected to the print head 6, which is, however, not shown in the figure. As implied in FIG. 1 and as the rest of the figures, especially FIGS. 4 & 5 show, the housing 3 has a lower housing part 12 and an upper housing part 13. The printing space 4, the printing device 5 with the print head 6 and the ink ribbon cartridge 7, the receiving device 8, the control and evaluation unit 10, and the storage device 11 are arranged in the lower housing part 12.

Figure 2A:
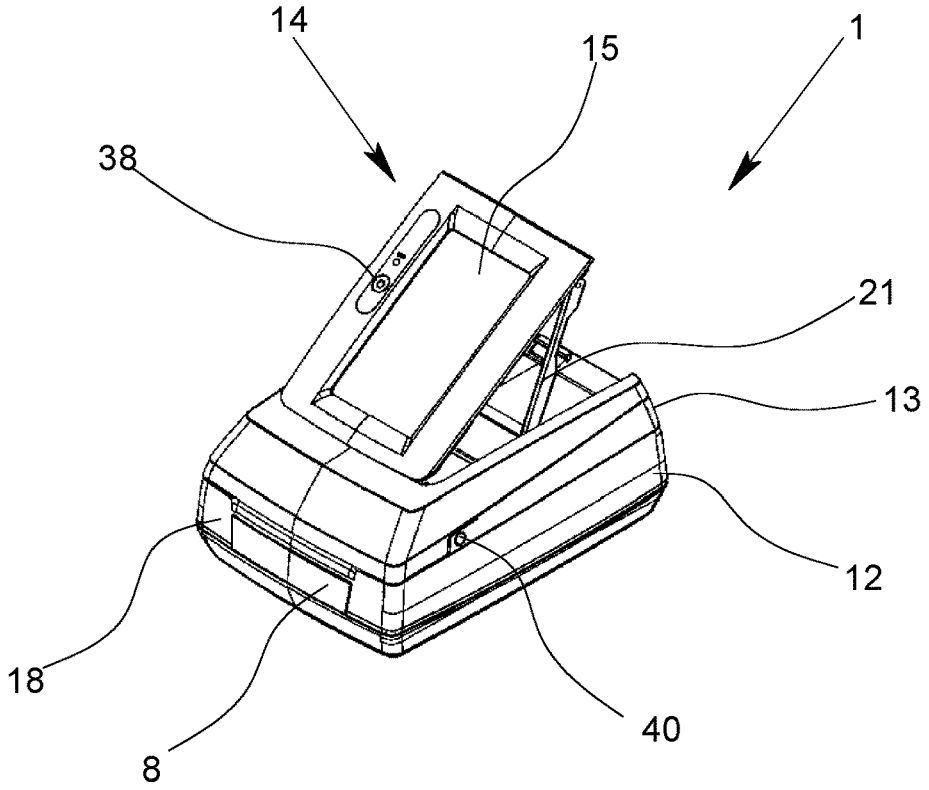
FIGS. 2*a* & 2*b* are perspective views of an embodiment of the printer with an upwardly pivoted tablet computer at an angle, as seen from the front and from the side, respectively.
Figure 2B:
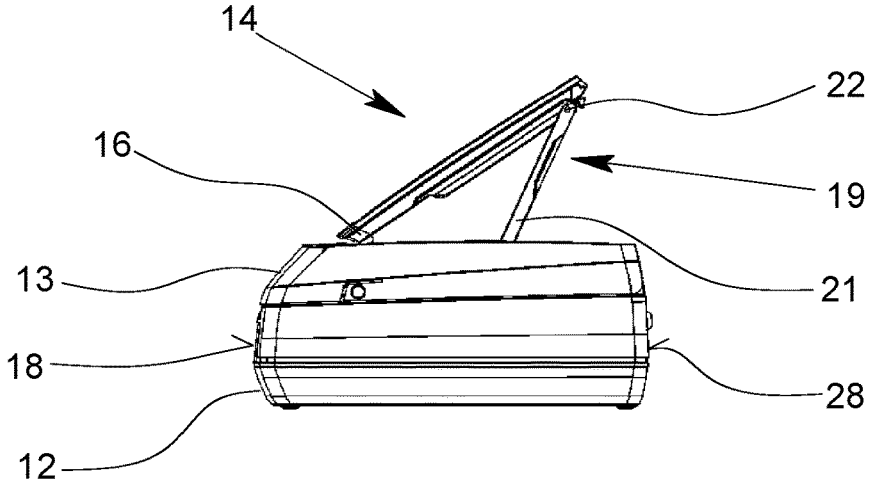

FIG. 2 shows that a tablet computer 14 with a touchscreen 15 is provided as the input and display device of the printer 1. The tablet computer 14 is mounted to pivot about a rotational axis 16 on the top side of the upper housing part 13. Furthermore, the upper housing part 13 is also mounted to pivot on the lower housing part 12, namely about a rotational axis 17, as shown especially in FIGS. 4 & 5. The rotational axis 16 of the tablet computer 14 is in the vicinity of the front side 18 of the printer 1, in which vicinity the receiving device 8 is also arranged, so that the tablet computer 14, in the upwardly pivoted position depicted in FIG. 2, faces a user who is in front of the front side 18 of the printer 1. From this position, the user will also load a object to be printed 2 into the extended receiving device 8.

Figure 3:
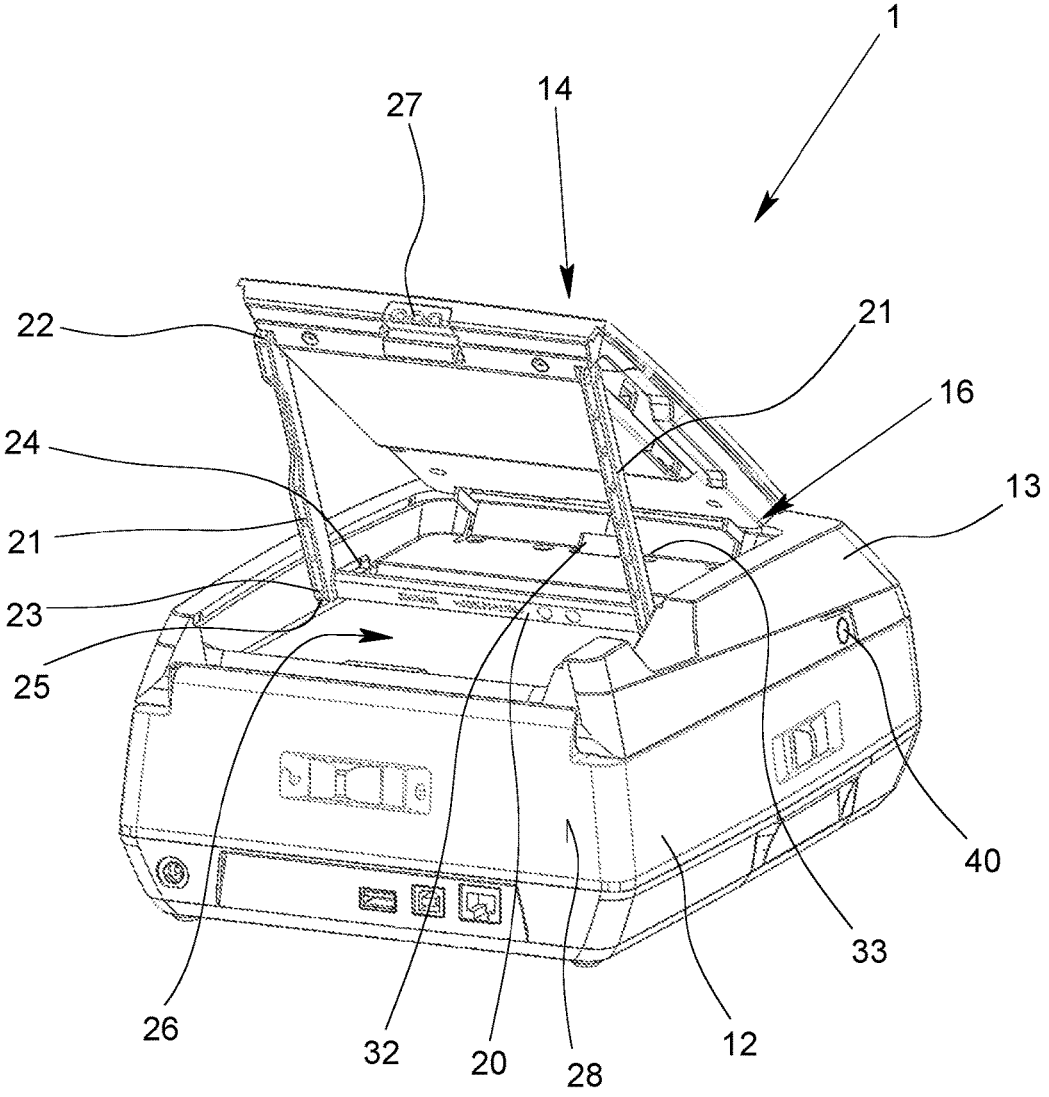
FIG. 3 is a perspective view of the printer according to FIGS. 2*a* & 2*b* view at an angle from the back.

In order to ensure that the tablet computer 14 is supported in the upwardly pivoted position and is also held there by means of a locking device when a user inputs printing data or printing parameters on the touchscreen 15 of the tablet computer 14, a U-shaped bracket 19 is arranged pivotably on the rear of the tablet computer 14, as FIG. 3 especially shows. The U-shaped bracket 19 has a crosspiece 20 extending between two lateral arms 21, wherein the ends 22 of the arms 21 opposite the ends connected to the crosspiece 20 are mounted to pivot on either side of the tablet computer 14. Outwardly protruding studs are arranged on the ends 23 of the arms 21 connected to the crosspiece 20. These studs each protrude into a guiding and locking groove 24, which grooves 24 are formed on the opposing long sides on the top side of the upper housing part 13. An indentation 25 is formed on one end of each of the guiding grooves 24, into which the studs formed on the arms 21 lock when the tablet computer 14 is in the upwardly pivoted position depicted in FIG. 3.

Figure 6:
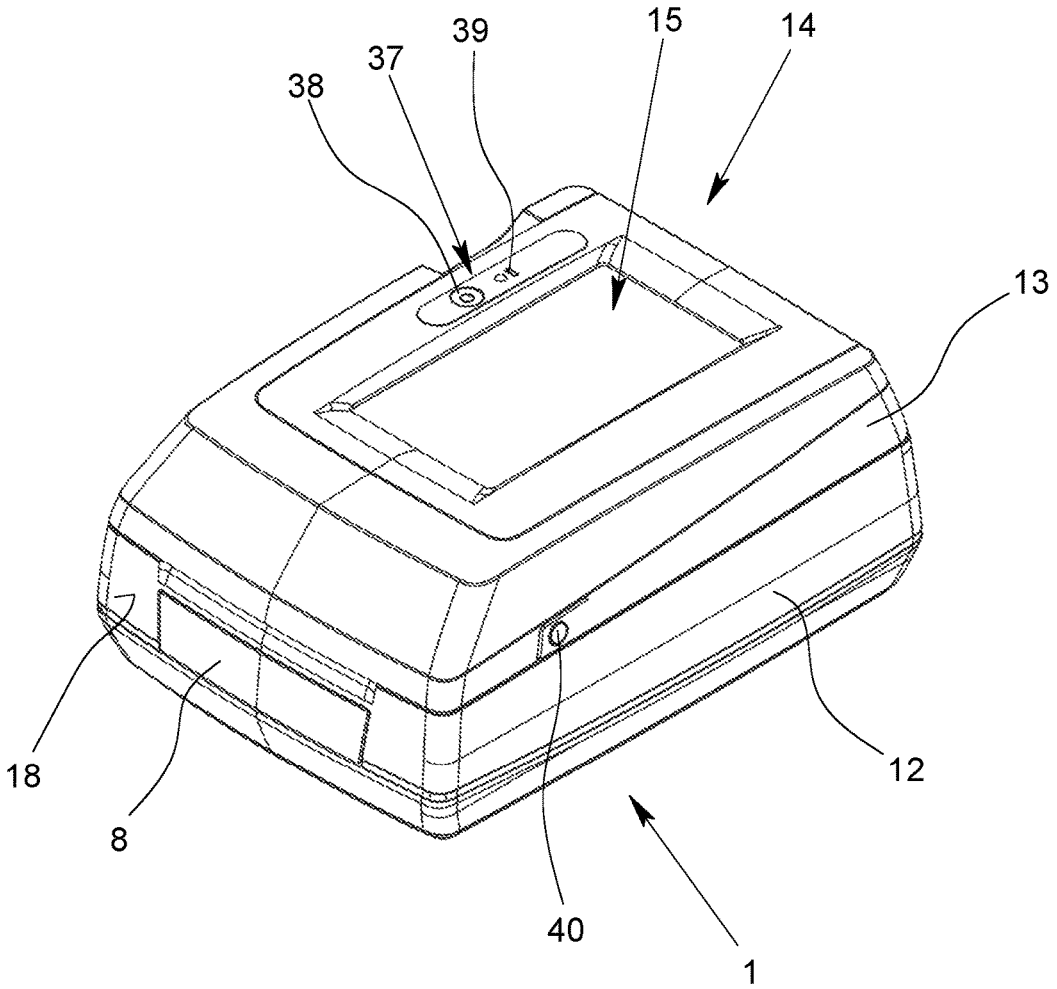
FIG. 6 is a perspective view of the printer with a downwardly pivoted upper housing part and a downwardly pivoted tablet computer.

To fold the tablet computer 14 in or pivot it downward, it is only necessary to gently raise the upper end of the tablet computer 14 or the bracket 19 so that the studs on the Arms 21 are lifted out of the indentations 25 of the guiding grooves 24. Following this, the Crosspiece 20 of the bracket 19 can be pulled against the rear of the tablet computer 14 so that the tablet computer 14 may then be lowered until it rests in the recess 26 in the top side of the upper housing part 13 (which is provided for this purpose). As a result, the top side of the tablet computer 14 is located essentially flush with the top side of the upper housing part 13 when lowered, as FIG. 6 shows. The button 27 provided on the upper edge of the tablet computer 14 ensures that the tablet computer 14 also latches in the downwardly pivoted position so that it is especially secured during transport.

FIG. 4 shows the preferred embodiment example of the printer 1 according to the invention with an upwardly pivoted upper housing part 13, while the tablet computer 14 is depicted in the folded-down position. It is immediately clear that the rotational axis 17 of the upper housing part 13 is arranged in the vicinity of the rear 28 of the printer 1 or of the lower housing part 12. FIG. 4 shows that the upper housing part 13 can also be latched in the upwardly pivoted position. For this purpose, a pivoting bracket 29 is attached to the upper housing part 13, which pivoting bracket 29 protrudes into an opening 30 in the top side of the lower housing part 12. A protrusion 31 formed on the pivoting bracket 29 forms, together with the edge of the opening 30, a latch for locking the upper housing part 13 in the depicted upwardly pivoted position.

The tablet computer 14 is connected via a flat ribbon cable 32 to the control and evaluation unit 10 in the lower housing part 12 for data exchange as well as power supply. For this purpose, a first opening 33 is provided in the upper housing part 13 near the rotational axis 16 of the tablet computer 14, and a second opening 34 is provided in the lower housing part 12 near the rotational axis 17, both for the flat ribbon cable 32. The flat ribbon cable 32 thus runs essentially in an S-shape from the corresponding connection point on the tablet computer 14 through the first opening 33, along the bottom of the upper housing part 13, through the second opening 34, and subsequently, inside of the lower housing part 12, to the control and evaluation unit 10. The flat ribbon cable 32 thereby runs snugly against the bottom side of the upper housing part 13, for which purpose a guiding groove may be formed on the bottom of the upper housing part 13 so that the flat ribbon cable 32 does not protrude over the bottom of the upper housing part 13. The flat ribbon cable 32 is thus also securely protected against damage when the upper housing part 13 is pivoted upward.

As FIG. 4 shows, the ink ribbon cartridge 7 is arranged underneath a cover 35. The cover 35, on whose bottom side the printer head 6 is attached, is mounted to pivot in the lower housing part 13 and is held in the closed position by the locking lever 36. To replace the ink ribbon cartridge 7, the locking lever 36 must first be rotated back so that the cover 35 (with the attached print head 6) can then be pivoted upwardly. Following this, a user can remove the ink ribbon cartridge 7 from the lower housing part 12 from the front and replace it with another ink ribbon cartridge 7.

FIG. 5 shows the printer 1 according to the invention with an upwardly pivoted upper housing part 13 and an upwardly pivoted tablet computer 14, wherein both the upper housing part 13 and the tablet computer 14 are locked in position. This depiction especially shows that the rotational axis 16 of the tablet computer 14 and the rotational axis 17 of the upper housing part 13 are arranged on different sides of the printer 1. The rotational axis 16 of the tablet computer 14 is near the front 18 of the printer 1, while the rotational axis 17 of the upper housing part 13 is near the rear 28 of the printer 1.

Lastly, FIG. 6 shows a perspective view of the printer 1 according to the invention with a downwardly pivoted upper housing part 13 and a downwardly pivoted tablet computer 14. The printer 1 is configured as a portable device that can be deployed as needed to different field sites by a user due to its low weight of circa 6 kg and its small footprint, which roughly corresponds to the dimensions of a DIN A4 sheet. In addition to the touch screen 15, the tablet computer 14 has an additional control panel 37 with an on/off switch 38 and an LED 39 that can show the charge level of the printer's 1 rechargeable battery. By pressing the buttons 40 formed on both long sides of the upper housing part 13, the latches 41 formed on the upper housing part 13 can be released so that the upper housing part 13 can be pivoted upwardly. If the buttons 40 are not pressed, the upper housing part 13 is locked in the downwardly pivoted position, such that the printer 1 is not only very compact but is also protected against undesired opening or damage.

What is claimed is:

1. A printer for printing objects for marking electrical components, comprising:

a housing enclosing a printing space, a printing device in the printing space, a receiving device for a magazine for receiving an object to be printed, a control and evaluation unit, and an input and display device, wherein the receiving device is movable between a loading and unloading position outside of the printing space and a printing position inside of the printing space, wherein the housing has a lower housing part and an upper housing part, wherein the printing space, the printing device, the receiving device, and the control and evaluation unit are arranged in the lower housing part, wherein a tablet computer is provided as the input and display device and is pivotably attached on a top side of the upper housing part so as to be able to pivot about a rotational axis, wherein means for locking the tablet computer in an upwardly pivoted position is provided, and wherein the upper housing part is pivotably mounted on the lower housing part to be able to pivot about a second rotational axis.

2. The printer according to claim 1, wherein the rotational axis of the tablet computer is arranged in the vicinity of the front of the printer, in which vicinity the receiving device is also arranged.

3. The printer according to claim 1, wherein the pivotable attachment of the tablet computer to the upper housing part comprises a U-shaped bracket or frame mounted to be able to pivot on the tablet computer and wherein a catch mechanism is formed between the U-shaped bracket or frame and the top side of the upper housing part.

4. The printer according to claim 3, wherein the U-shaped bracket comprises a crosspiece and two arms, a first end of which is connected to the crosspiece and opposite second ends of the arms are mounted to be able to pivot on either side of the tablet computer, wherein outwardly protruding studs are arranged on the first ends of the arms, and wherein two lateral guiding and locking grooves, lying opposite each other are formed on the top side of the upper housing part, and into which the studs extend.

5. The printer according to claim 1, wherein the second rotational axis of the upper housing part is arranged near a rear of the printer and wherein the upper housing part is lockable in an upwardly pivoted position.

6. The printer according to claim 1, wherein the tablet computer is connected via a cable to the control and evaluation unit for data exchange, for which purpose a first opening for the cable is provided in the upper housing part near the rotational axis of the tablet computer and a second opening for the cable is provided in the lower housing part near the second rotational axis, and wherein the cable runs essentially in an S-shape from the tablet computer through the first opening, along the bottom of the upper housing part to the second opening, and through the second opening to the control and evaluation unit inside of the lower housing part.

7. The printer according to claim 6, wherein a cover that covers the cable is arranged on an underside of the upper housing part.

8. Printer according to claim 1, wherein a charger interface for the power supply of the tablet computer is arranged at a top area of the upper housing part.

9. The printer according to claim 8, wherein data exchange between the tablet computer and the control and evaluation unit occurs wirelessly.

* * * * *